US005939826A

United States Patent [19]

Ohsawa et al.

[11] Patent Number: 5,939,826

[45] Date of Patent: Aug. 17, 1999

[54] PLASMA DISPLAY SYSTEM

[75] Inventors: Michitaka Ohsawa, Fujisawa; Hiroshi Ohtaka, Yokohama; Keirou Shinkawa, Hiratsuka; Ken Hashimoto, Mobara; Nobuyuki Ushifusa, Yokohama; Seiichi Tsuchida, Yokosuka; Tatsuro Kawamura, Tama; Teruo Takai, Isehara, all of Japan

[73] Assignee: Hitachi, Ltd., Tokyo, Japan

[21] Appl. No.: 08/548,614

[22] Filed: Oct. 26, 1995

[30] Foreign Application Priority Data

Nov. 11, 1994 [JP] Japan ..... 6-277751

[51] Int. Cl.[6] ..... H01J 14/49; H01J 01/62; H01J 633/04

[52] U.S. Cl. ..... 313/582; 313/586; 313/587; 313/484; 313/485

[58] Field of Search ..... 313/580–587, 313/110, 112, 113, 484–495; 345/41, 32, 37, 84; 359/359, 577, 581, 584, 589

[56] References Cited

U.S. PATENT DOCUMENTS

| | | | |
|---|---|---|---|
| Re. 33,729 | 10/1991 | Perilloux | 359/359 |
| 3,983,445 | 9/1976 | Yasuda et al. | 313/485 |
| 3,986,074 | 10/1976 | Watanabe et al. | 313/485 |
| 4,224,553 | 9/1980 | Hellwig . | |
| 4,352,042 | 9/1982 | Lorenz et al. . | |
| 4,563,617 | 1/1986 | Davidson . | |
| 4,602,847 | 7/1986 | Born et al. | 313/589 X |
| 4,692,662 | 9/1987 | Wada et al. | 313/113 X |
| 5,086,297 | 2/1992 | Miyake et al. | 313/485 X |
| 5,136,207 | 8/1992 | Miyake et al. | 313/582 |
| 5,182,489 | 1/1993 | Sano | 313/113 |
| 5,218,268 | 6/1993 | Matsuda et al. | 313/112 |
| 5,448,404 | 9/1995 | Schrenk et al. | 359/584 |
| 5,541,479 | 7/1996 | Nagakubo | 313/113 |

FOREIGN PATENT DOCUMENTS

| | | |
|---|---|---|
| 0166372 | 1/1986 | European Pat. Off. . |
| 0284138 | 9/1988 | European Pat. Off. . |
| 59-36280 | 2/1984 | Japan . |
| 61-6151 | 1/1986 | Japan . |
| 61-24126 | 2/1986 | Japan . |

*Primary Examiner*—Sandra O'Shea
*Assistant Examiner*—Mack Haynes
*Attorney, Agent, or Firm*—Antonelli, Terry, Stout & Kraus, LLP

[57] ABSTRACT

A plasma display panel for plasma display system provides excellent optical characteristics, including a color purity, contrast, and luminance, of a plasma display system. Barrier ribs forming a cell has wavelength-selective reflective filters for reflecting only a light of wavelength needed for display and absorbing the other lights coated thereon. The wavelength-selective reflective filters have phosphors coated thereon. A color filter is inserted between a first front panel and second front glass panel for feeding out the light in a sandwich state.

15 Claims, 7 Drawing Sheets

1 ···BACK PLATE 2 ···BARRIER RIB 3 ···1ST FACE PANEL
4 ···COLOR FILTER 5 ···BLACK MATRIX 6 ···2ND FACE PANEL
7 ···PHOSPHOR 8 ···THIN FILM REFLECTION FILTER
S ···CELL 2 1 ···DATA LINE ELECTRODE 2 2 ···SCAN LINE ELECTRODE

1 ···BACK PLATE 2 ···BARRIER RIB 3 ···1ST FACE PANEL
4 ···COLOR FILTER 5 ···BLACK MATRIX 6 ···2ND FACE PANEL
7 ···PHOSPHOR 8 ···THIN FILM REFLECTION FILTER
S ···CELL 2 1 ···DATA LINE ELECTRODE 2 2 ···SCAN LINE ELECTRODE

PLASMA DISPLAY SYSTEM

BACKGROUND OF THE INVENTION

The present invention relates to a plasma display system having a plasma display panel for use as a display, particularly as a thin display panel in which the energy of a ultraviolet ray excites phosphors to obtain visible lights.

A plasma display panel (hereinafter referred to as the PDP) is made of small plasma light emitting cells each of which is enclosed by barrier ribs, a face panel, and a back plate at each of crossing portions of stripe data line electrodes and scanning line electrodes crossing like a matrix. The plasma light emitting cells have a phosphor corresponding to one of three primary colors provided thereinside. If a plasma is discharged as selected by the data line electrode and the scanning line electrode, the plasma generates an ultraviolet ray. The ultraviolet ray excites the phosphor to emit a light, thereby forming a picture element of the plasma display system.

In the Japanese Patent Application Laid-Open (TOKU-KAI-SHO) No. 61-24126 is disclosed a first prior art that color of the substance used for the barrier ribs forming the cells is changed from white to black so that absorption of the lights emitted by the phosphors excited by the ultraviolet ray is made as little as possible to increase the luminance of the above-described plasma display panel (PEP). The first prior art uses the substance containing no black pigment for forming the barrier ribs to increase the reflection factor of the lights to reflect the lights emitted by the phosphors effectively.

Also, in the Japanese Patent Application Laid-Open (TOKU-KAI-SHO) Nos. 59-36280 and 61-6151 is disclosed a second prior art that the cells have optical filters of inorganic substances attached to the openings thereof for color lights to increase the color purity and contrast of the PDP. The second prior art having the optical filters inside the light emitting cells can have a desired thickness of the face panel since the thickness does not cause such errors of phenomena that parts of the light do not pass the filter and passes the filter of different color.

The above-mentioned first prior art can increase the reflection factor to increase the luminance since the color of the substance used for the barrier ribs forming the cells is white. However, the first prior art has the disadvantage that the color purity is decreased since the substance reflects the lights of all wavelengths and if the spectra of the lights emitted by the phosphor are not of a single wavelength, the substance reflects the lights of undesired wavelengths. The first prior art also has the disadvantage that any possible coming external light causes deteriorations of characteristic performance, such as decrease of contrast, not taking into account the deteriorations of optical characteristic performance. The first prior art further has the disadvantage that the substance cannot always reflect the ultraviolet ray for exciting the phosphor effectively although reflecting the visible lights.

The above-mentioned second prior art is ideal in the principle that as described above, thickness of the face panel causes no error. However, the second prior art has the disadvantage that as a realistic problem, the filter has to be made of the substance the characteristics of which cannot be changed by ultraviolet ray since the filter put in the light emitting cell is always exposed to strong ultraviolet ray. The second prior art also has the disadvantage that the filter has to endure the high-temperature heat process of 500 to 600° C. unavoidable for fabrication of the panel since the filter is attached to the face panel. The second prior art further has the disadvantage that the substance discharging undesired gases is impractical since the substance forming the filter is put in the cell. For those reasons, the substance for the filter is so limited as to meet the optical characteristics. The filter is made of the inorganic substance in the current situation, but is inferior to the ones of organic substances used in the CCD employed widely as image device and liquid crystal display panel. However, the organic substance filters cannot be currently treated in the high-temperature process so that the PDP cannot make full use of the excellent optical characteristics of the organic substance filter.

Also, the prior plasma display panels have the disadvantage that the face panel for feeding out the emitted light is made usually of a simple flat glass and is not shaped in view of directivity of the output light. For the reason, the prior plasma display panels cannot have high efficiency of the output light where wide directivity is not always needed.

SUMMARY OF THE INVENTION

In view of solving the foregoing problems of the prior arts, it is an object of the present invention to provide a plasma display system that can increase color purity and contrast while increasing luminance.

A more specific object of the present invention is to increase the luminance, color purity, and contrast of each cell of the plasma display panel.

Another object of the present invention is to make the PDP that can use an optical filter of an organic substance having excellent optical characteristics, particularly in a wavelength selectivity.

Still another object of the present invention is to increase the luminance for the plasma display system having directivity allowed for.

To accomplish the above-mentioned objects, the present invention provides the following features.

A fundamental feature of the present invention is that each cell of the PDP has first means for increasing the color purity of the light emitted in the cell and/or second means for the color purity of the light to be fed out of the cell. More specifically, the first means for increasing the color purity of the light emitted in the cell is made to have a reflective surface excellent in the wavelength selectivity on an inside of the cell having a phosphor.

To increase the luminance of each cell of the PDP, it need hardly be said that the light emitted by the phosphor has to be fed out so as not to be absorbed possibly. The lights of wavelengths other than the one needed for display, whether the lights are emitted by the phosphors or external lights, have to be all absorbed. However, since the PDP uses the ultraviolet ray to excite the phosphor, absorption of the ultraviolet must be made as little as possible.

To meet above-mentioned limits at the same time as a feature of the present invention, the present invention is made to have a filter coated with a substance capable of effectively reflecting the light desired to display or an interference film filter of a plurality of layers of different refractions overlapped alternately.

Each of the reflective filters (wavelength-selective reflective filters) attached to walls forming the cell depend greatly on optical characteristics of the material used, such as a pigment. If the material has a high reflection factor for a wavelength of the respective three primary color lights needed for display and on the contrary, has high absorption factors for the ones of the other lights, it can increase without decreasing the color purity and contrast. Of course, it is not needed for the optical characteristics for the wavelengths to allow one substance for the three spectra of the three primary colors. The reason is that the light emitting cell is optically independent of the three respective primary colors. Rather, to make the optical characteristics to a great extent, one substance should have a greatly high reflection factor for one spectrum of the three primary colors and absorb the other spectra well and should correspond to the respective three kinds of display color.

As described above in detail, the substance (pigment) is coated to the surfaces of the barrier ribs and the bottom of each cell of the three primary colors, for example, red, green, and blue, before coating the phosphor onto it. Such a structure allows the emitted light to be fed out without loss and the lights other than the desired light of wavelength to be absorbed. This can increase the output light and at the same time, unlike the white reflection panel, can increase the color purity and contrast. If the phosphor has approximate amount of a pigment or the like mixed therewith, the improvement effects can be made higher.

Of the above-mentioned two means, the means for increasing the purity of the light to be fed out of the cell is achieved as an optical filter having high wavelength selectivity. More specifically, the means can be formed of an organic substance filter or an interference film filter. It is advantageous that the optical filter of the organic substance having the high wavelength selectivity should be provided through transparent means, such as a glass plate, to the cell.

That is, in the panel production process having a high-temperature process step, the substance for the organic substance filter is not attached to the face glass plate, but attached after completion of the high-temperature process step. Alternatively, the substance is attached in advance to a part having needed the high-temperature process before being integrated with the other parts at the final process step to complete. For the reason, the face panel is made up of a thin first face panel inside it and a second front glass panel outside it. If the organic substance filter is directly attached to the first face panel because of the heat process step of the panel, for example, the organic substance filter is attached to the second front glass panel in advance. At the final step after completion of all the heat treatments, the first face panel and the second front glass panel are attached together to have the organic substance filter put therein. Such a process and construction as having the organic substance filter can solve the problem of durability of the prior arts for the ultraviolet ray and the problem of discharge of gases into the cells. As to the problem of the adverse effect due to deviation of the light transmission path and the filter as looked obliquely when the filter is attached outside the cell, the first face panel is made thin to make it no practical problem.

As for the optical filter attached to the face panel available for the PDP of the present invention, it can be made of the organic substance having superior optical characteristics. The organic substance filter can increase the color purity of the emitted light to a great extent and at the same time, reduce decrease of the contrast due to external lights. If the second front glass panel is made to have functions of an optical lens and prism, directivity of the output light can be controlled easily, thereby being capable of further increasing luminance.

As described so far, the present invention has the advantage that it can use the substance having the beneficial characteristics for the optical filters to increase the luminance while increasing the color purity and the contrast. Also, the present invention has the advantage that it can use the black substance effective for the barrier rib to increase the contrast of the panel in itself, thereby enabling increase of the optical characteristics of the panel.

The foregoing and other objects, advantages, manner of operation and novel features of the present invention will be understood from the following detailed description when read in connection with the accompanying drawings.

DETAILED DESCRIPTION OF THE PREFERRED EMBODIMENT

Figure 1:
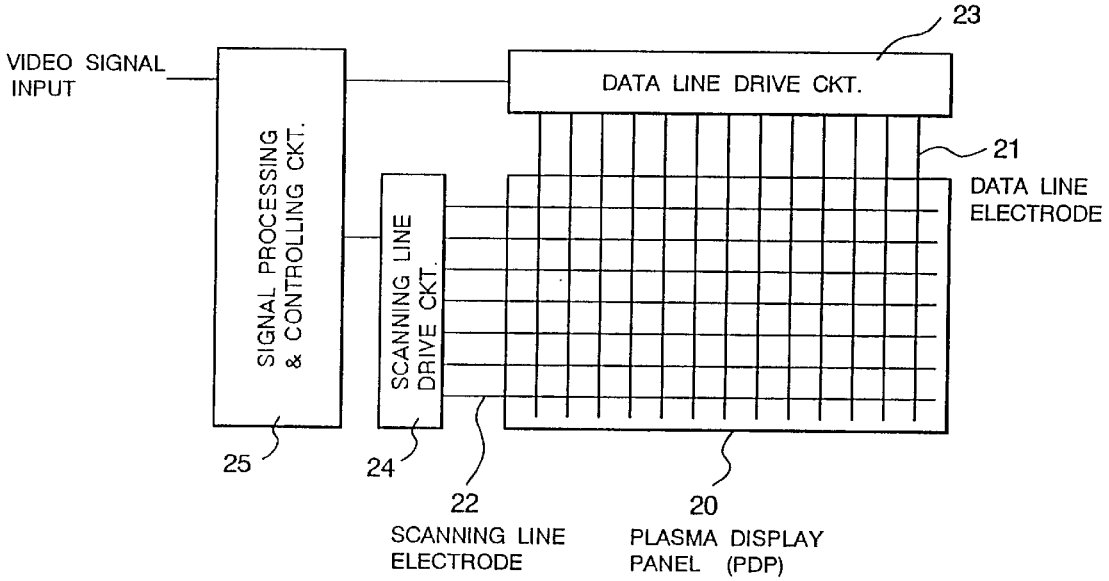
FIG. 1 is a block diagram illustrating the plasma display system according to the present invention.

FIG. 1 depicts a block diagram illustrating the plasma display system according to the present invention. A plasma display panel 20 has a data line electrode 21 and a scanning line electrode 22. The data line electrode 21 and the scanning line electrode 22 are connected with a data line drive circuit 23 and a scanning line drive circuit 24, respectively. The data line drive circuit 23 and the scanning line drive circuit 24 apply drive voltages to the electrodes connected therewith as receiving a signal from a signal processing and controlling circuit 25. The data line electrode 21 and the scanning line electrode 22, which are arranged in a matrix form, generates discharge at an intersection point thereof as having the drive voltages applied thereto depending on a video signal.

Figure 2:
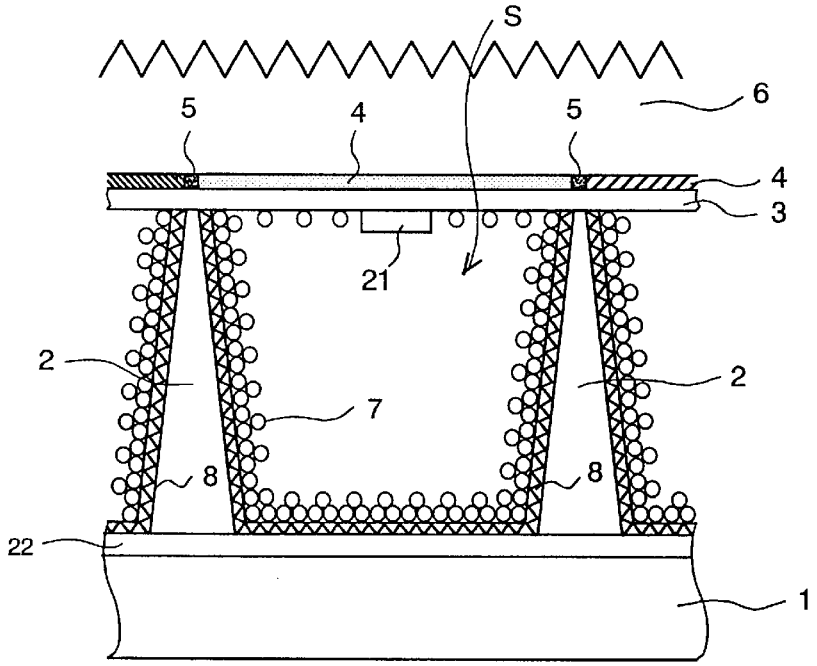
FIG. 2 is a cross-sectional view illustrating major portions of a first embodiment of the plasma display panel according to the present invention.

FIG. 2 depicts a cross-sectional view illustrating major portions of a first embodiment of the plasma display panel according to the present invention. The major portions include a single cell that is a light emitting area (discharge space spatially separated for each light color, the light emitting area being a unit light discharge space.

As shown in FIG. 2, the plasma display system are formed of a background glass plate 1 (hereinafter referred to as the back plate 1), barrier ribs 2 for spatially separating the cell, a first front glass 3 (hereinafter referred to as the first face panel 3) formed of thin flat glass plate, a color filter (organic substance filter) 4 formed of an organic substance for selecting a wavelength of an output light, a black matrix 5 for absorbing a light, a second front glass plate 6 (hereinafter referred to as the second front glass panel 6) having an optical element, such as a microprism or microlens, a phosphor (phosphor film) 7, a wavelength-selective reflective filter (thin film reflection filter) 8 for reflecting a light of specific wavelength while absorbing lights of wavelengths other than that one, the cell S that is the light emitting area spatially separated for each light color.

In the figure are indicated the data line electrode 21 and the scanning line electrode 22 shown in FIG. 1.

That is, FIG. 2 depicts a a cross-sectional view of the plasma display panel 20 cut out along the scanning line electrode 22, illustrating a cell 26 defined by the intersection point of the data line electrode 21 and the scanning line electrode 22. A space between the first face panel 3 and the back plate 1 is partitioned by the barrier ribs 2 to, for example, a stripe form or a lattice form. The space enclosed by the barrier ribs 2 is filled with a rare gas. If the drive voltages produces an electric field between the data line electrode 21 and the scanning line electrode 22 to generate a plasma discharge, the discharge generates an ultraviolet ray. The ultraviolet ray excites the phosphor 7 to emit a light. The cell defined at the intersection point of the data line electrode 21 and the scanning line electrode 22 forms a picture element. The picture elements can display an image on the plasma display panel 20.

The wavelength-selective reflective filter (thin film reflection filter) 8 of the first embodiment is coated on surfaces of the barrier ribs 2 and between a bottom of the cell S and the phosphor 7 for each of three display primary colors, including red, green, and blue. The filter is formed of a substance (pigment) having a very high reflection factor to one respective spectrum of the three primary colors while absorbing the other spectra. The phosphor 7 has appropriate amount of a pigment mixed therewith depending on the respective one of the three color cells as needed.

The function of the wavelength-selective reflective filter 8 can be alternatively served by the barrier ribs 2 and the bottom of the cell S themselves in the way that the barrier ribs 2 and the bottom of the cell S are formed of appropriately selected substances and are mixed with a substance that can reflect only the spectrum needed to display.

Also, the wavelength-selective reflective filter 8 may be alternatively replaced by an interference film filter (multilayer interference film filter) having optical characteristics. FIG. 10 depicts an enlarged cross-sectional view illustrating a plasma interference film filter. The interference film filter is formed to have thin films of different refraction factors n overlapped alternately to make an interference to reflect or make only the necessary spectrum components pass through. The interference film filter should be designed to reflect only the necessary wavelength components. It is effective as described in detail later by reference to FIG. 9 to form the thin film interference film filter (multi-layer interference film) on inside surfaces of the face panels to reflect an ultraviolet ray, but transmit only the visible light.

As described above, the discharge is made selectively for each cell S. The ultraviolet ray generated by the discharge excites the phosphor 7. At the same time, visible light of spectra specific to the phosphor is fed out through the first face panel 3, the color filter 4, and the second front glass panel 6. To make the ultraviolet ray excite the phosphor 7 sufficiently and effectively, the wall surfaces of the barrier ribs 2 and the bottom (bottom surface) of the cell S have the phosphor (phosphor film) 7 formed thereon to make the phosphor 7 have sufficient surface area. Also, to use the ultraviolet ray effectively, the face panel may have the phosphor 7 coated on an output side thereof so thinly as to transmit the visible light. However, it should be careful that if the phosphor 7 is too much, the desired visible light is attenuated.

Parts of the lights coming out of the phosphor 7 are fed out through the first face panel 3, the color filter 4, and the second front glass panel 6 as it is. The lights generated toward the barrier rib 2 and the bottom of the cell S have only a wavelength of necessary spectrum reflected by the wavelength-selective reflective filter 8 (or multi-layer interference film) and has the remaining wavelengths of undesired spectra absorbed by the wavelength-selective reflective filter 8 (or multi-layer interference film). Thickness of the phosphor 7 coated onto the wavelength-selective reflective filter 8 and the like has to be optimized so that the phosphor 7 should absorb most of the ultraviolet ray generated by the discharge. The optimization of the thickness of the phosphor 7 provides such an advantage as preventing the irradiation of ultraviolet ray to the pigment of the wavelength-selective reflective filter 8 from deteriorating characteristics of the pigment.

In turn, the following describes a structure and function of the color filter 4 of the first embodiment by reference to FIG. 2. As described above, the ultraviolet ray generated by the discharge in the cell S excites the phosphor 7 coated in the cell S to produce the visible light. The light generated from the phosphor 7 before being fed out of the opening from the cell S passes the thin first face panel 3 first. If the first face panel 3 is too thick, the light fed out of the cell S may not coincide with the color filter 4 having the light pass through as looked obliquely, or the tone of color may be changed with angle of looking. For the reason, the first face panel 3 has to be made as thin as possible. For the PDP, the first face panel 3 can be made relatively thin with respect to strength since the PDP has no vacuum in the cell S and the barrier rib 2 serves to support the atmosphere. The first embodiment makes use of such a feature to make the first face panel 3 thin and provide the color filter 4 (organic substance filter) on a side opposite to the cell S in the first face panel 3. The color filter 4 should have an area of each color made a little larger than an opening area of the cell S to make less the error of sight due to the thickness of the first face panel 3 even if it is looked obliquely.

Figure 3:
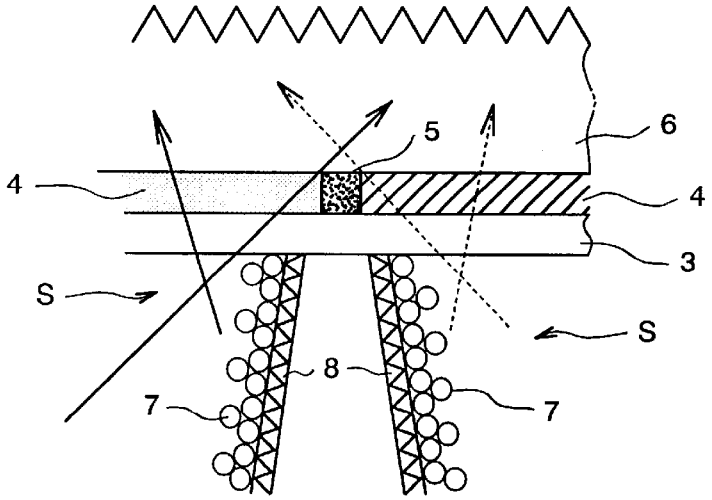
FIG. 3 is an enlarged cross-sectional view illustrating an area around tops of barrier ribs in FIG. 2.

The color filters 4 (organic substance filters) of different colors have a distance thereamong decided in terms of the thickness of the first face panel 3 and design conditions of the angle of sight If the color filters 4 have a gap thereamong, the gap is coated with a black light-absorbing substance therein to form the black matrix 5. The black matrix 5 (black portion) is positioned at tops of the barrier ribs 2 so that it will not be disadvantageous to luminance and the like. If the barrier rib 2 is white, the black matrix 5 can rather prevent reflection of an external light from the barrier rib 2 from lowering contrast. If an area of the black portion is too wide, it is effective to prevent the reduction of contrast, but it is a problem that if the display shows a simple pattern, such as a single color or the same luminance on a whole screen, the screen becomes black among the picture elements. This results in no smooth image. For the reason, in some case, the area of the color filter 4 should be made larger. Consequently, the color filter 4 should be designed optimum in view of contrast characteristic. FIG. 3 depicts an enlarged cross-sectioned view illustrating an area around the tops of the barrier ribs 2 in FIG. 2. As shown in the figure, a ratio of the area of the color filter 4 to that of the black matrix (black portion) 5 is decided depending on allowance of the angle of the light coming obliquely.

Forming the color filter 4 depends on a maximum temperature at which the panel is formed. That is, if the filter is formed of the organic substance as in this first embodiment, a panel forming temperature has to be made lower than at a temperature that the substance of the organic substance filter can endure, or the heat-resistance temperature of the filter has to be higher than the panel forming temperature. However, the usual panel forming temperature for the PDP currently reaches as high as 600° C. at maximum, while the heat-resistance temperature of the substance of the organic substance filter is around 150 to 200° C. For the reason, it is a current situation that the organic substance filter and members of the face panel cannot be formed in integration before a heat process of the panel. The present invention does not deny that in future, they will be possibly formed in integration before the heat process of the panel if the panel forming temperature for the PDP will be made lower or if the heat-resistance temperature of the organic substance filter will be made sufficiently higher. However, the first embodiment uses the current organic substance filter for use with the panel fabricated in the high-temperature process. That is, since the back plate 1 has the color filter (organic substance filter) 4 positioned on the observation side of the first face panel 3, they can be elaborated as desired. For example, when the high-temperature process is not needed after the panel forming, the first face panel 3 may under printing, spraying, coating, or similar optimum processes, or after the second front glass panel 6 has the color filter 4 formed thereon, these may be stuck to the thin first face panel 3.

Figure 4:
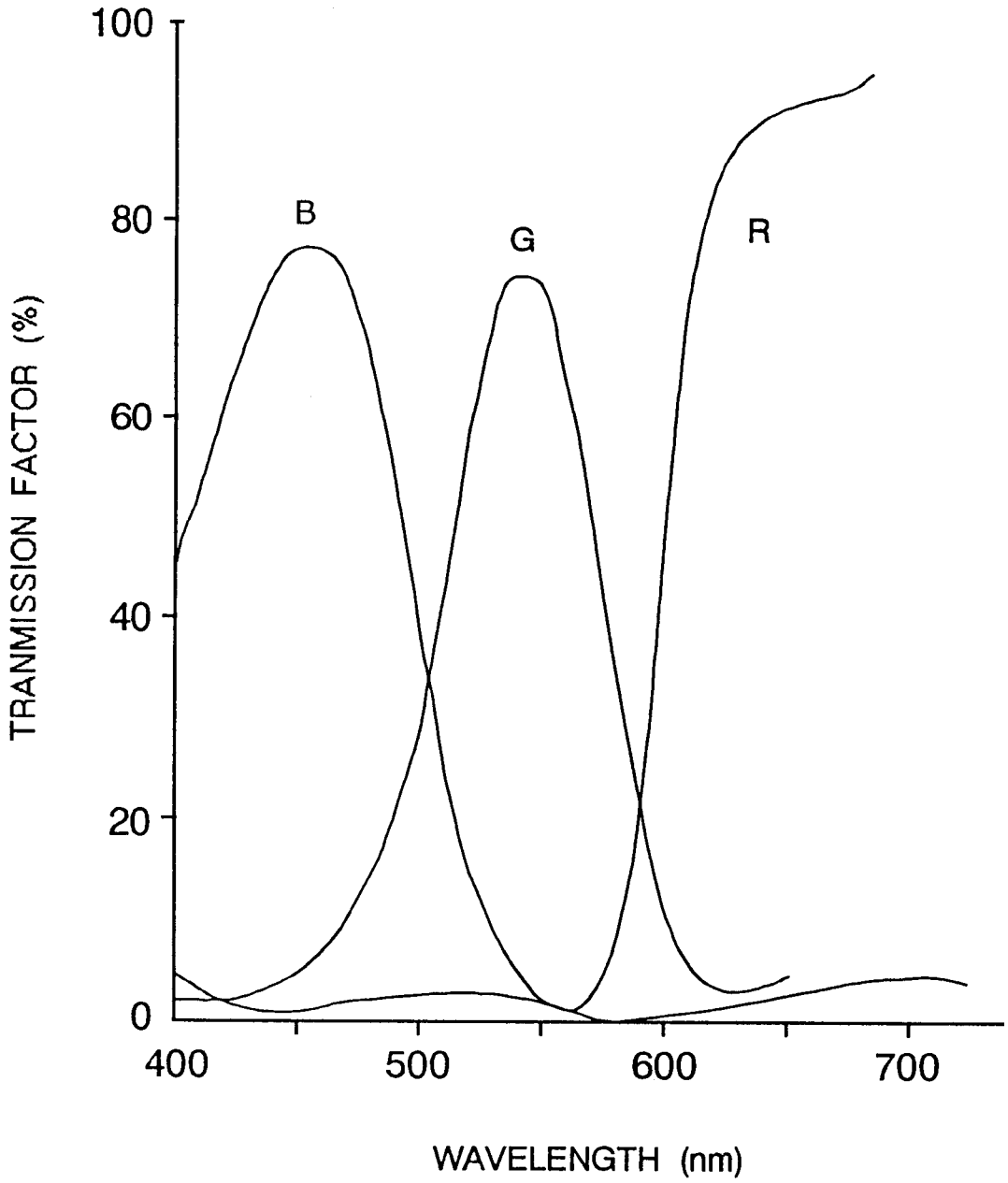
FIG. 4 is a graph illustrating an example of light transmission characteristics of color filters of the first embodiment.

FIG. 4 depicts a graph illustrating an example of light transmission characteristics of the color filters 4 of three primary colors, R, G, and B, of the first embodiment. The substance of each color filter 4 should be selected so that a center of the transmission wavelength should be brought into wavelengths required for display. (It is ideal that the selection should be made so that the center of the wavelength is fitted in the wavelengths required for display.) The output light can be made bright and little in the loss with the transmission factor being high. The color purity can be made high as a transmission bandwidth is narrow.

Figure 5:
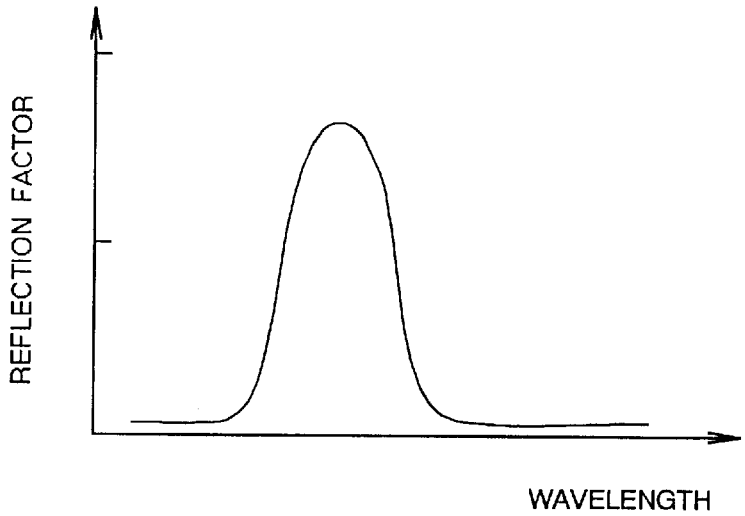
FIG. 5 is a model curve illustrating an optical characteristic of wavelength-selective reflective filter of the first embodiment.

FIG. 5 depicts a model curve illustrating an optical characteristic of the wavelength-selective reflective filter 8 of the first embodiment. As shown in the figure, such a wavelength selectivity of the wavelength-selective reflective filter 8 allows feeding out only the wavelength components needed for display to increase also a optical characteristic of the cell as compared with the reflection of all the wavelengths in the visible range. That is, the wavelength-selective reflective filter 8 can reflect only the lights of necessary wavelength while absorbing the other undesired lights. If the characteristics of the cells are fitted with the required three display primary colors, red, green, and blue, we can realize the cells having high color, or excellent optical characteristics, such as color reproducibility. The wavelength-selective reflective filters 8 can be made up of a pigment or the like. The reflective filters, unlike the transmission films, has advantages for fabrication, such as no necessity of using powder of fine grain diameter.

Figure 6:
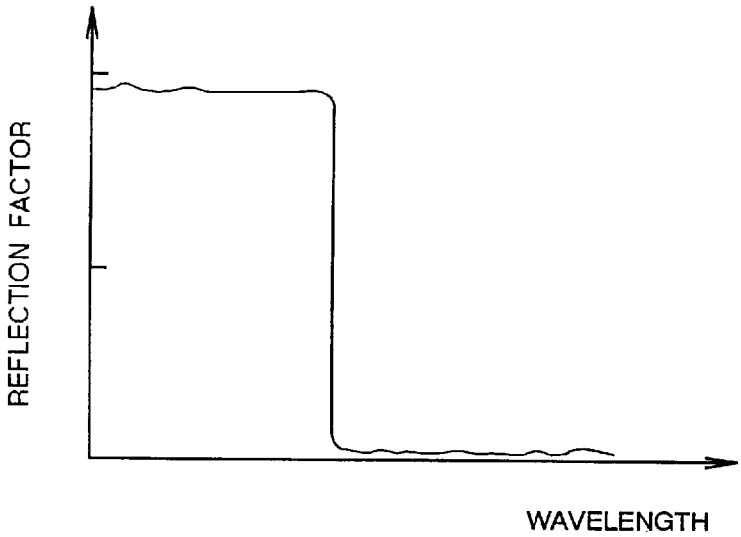
FIG. 6 is a model curve illustrating a characteristic of a thin film interference film filter, which is substituted for wavelength-selective reflective filter, formed of a plurality of thin films of different refraction factors.

FIG. 6 depicts a model curve illustrating a characteristic of the thin film interference film filter (multi-layer interference film), which is substituted for the wavelength-selective reflective filter 8 as described above, formed of a plurality of thin films of different refraction factors overlapped alternately to make interferences. Some elaboration of filter design can make a bandpass filter having such a narrow transmission bandwidth as shown in FIG. 5. As an example, the multi-layer interference film is effective in a case that we must use the phosphor 7 that emits the light the spectra of which include undesired spectra right close to the desired wavelength to display, thereby feeding out only the light needed to display. If the multi-layer interference film is used, it adversely passes most of the lights other than the reflected display light without attenuation. Therefore, the barrier ribs 2 have to be made to absorb the undesired lights, for example, made black. Such a device can absorb most of the undesired lights to increase the color purity and contrast.

It is well known that as shown in FIG. 10, the optical filtration characteristic of the interference film filter can be controlled with the film thickness as the interference film filter is overlapped usually of ten or more thin films of different refraction factors n alternately, that is, thin films of refraction factors n1 and n2 (n1 is not equal to n2). As a number of the layers of the multi-layer interference film is increased, its ratio of reflection to absorption can be made high, thereby being capable of making sharp an optical cutoff characteristic of the film. It is also known that the interference film filter of fewer layers has a broader cutoff characteristic. The interference film filter, therefore, should be designed depending on the desired optical characteristic and fabrication cost.

Figure 7:
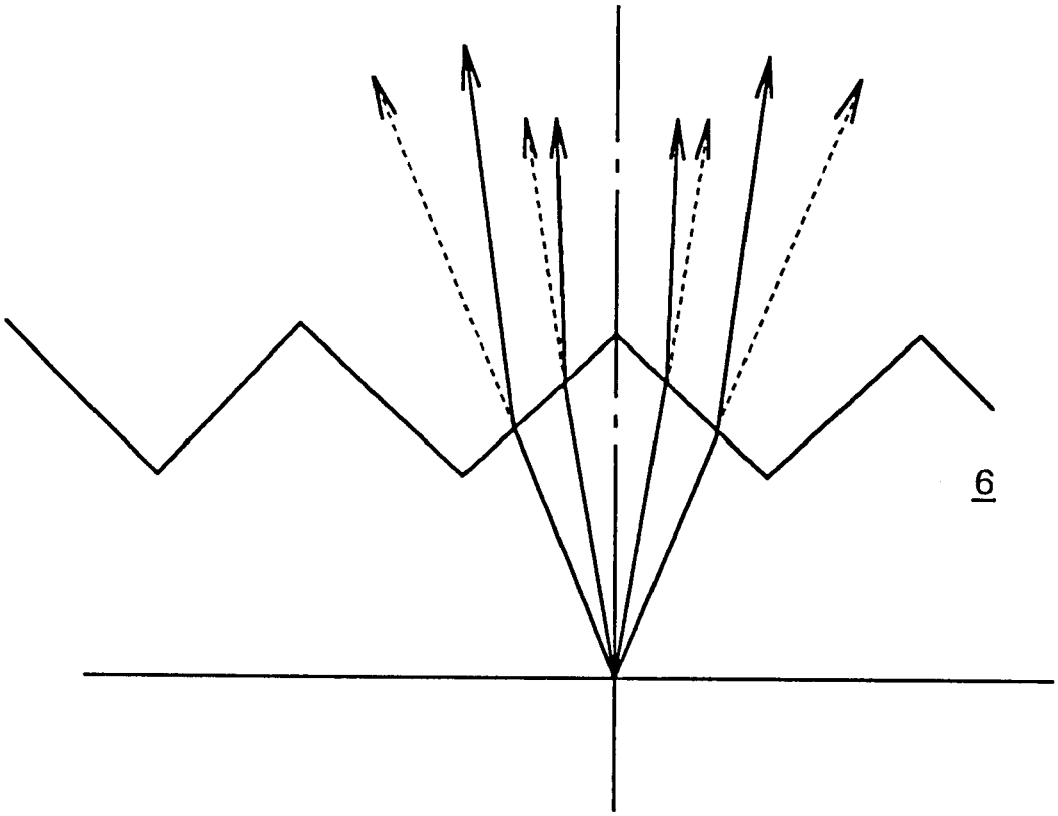
FIG. 7 is an enlarged cross-sectional view illustrating a microprism of a second front glass panel of the first embodiment.

FIG. 7 depicts an enlarged cross-sectional view illustrating a microprism of the second front glass panel 6 of the first embodiment. The second front glass panel 6 of the first embodiment has a corrugation of a multiple of sawtooth triangles on an outside thereof to have an optical prism function for controlling a direction of the output light thereof. Solid lines in the figure indicate the light output in the first embodiment, while broken lines are a light output without the optical prism function for controlling the direction of the output light. The PDP emitting the light by itself is featured greatly in very broad directivity. The first embodiment is useful in such applications that the broad directivity is needed.

The second front glass panel 6 has the advantage that the substance for the second front glass panel 6 can be selected in view of workability and optical characteristic as desired since the second front glass panel 6 can be attached after completion and is independent of the high-temperature process and air-tightness of a gas in the cells. The reason is that the airtightness is can be kept by the above-described first face panel 3.

The above-described first embodiment has the microprism attached on the side of sight of the second front glass panel 6 to control the directivity of the output light. The microprism can be replaced by a lenticular lens or can be shaped to have an additional microlens.

Figure 8:
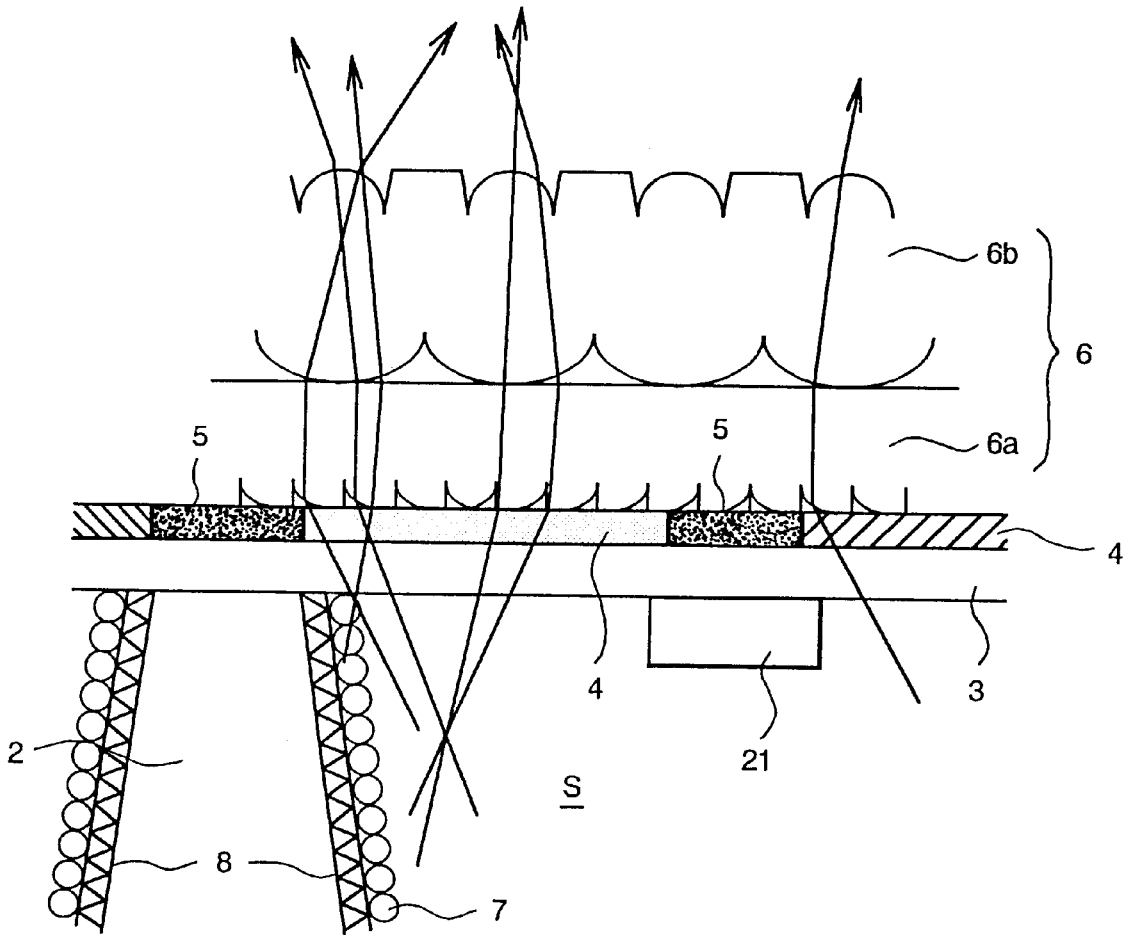
FIG. 8 is a cross-sectional view illustrating major portions of a second embodiment of the plasma display system according to the present invention.

FIG. 8 depicts a cross-sectional view illustrating major portions of a second embodiment of the plasma display system according to the present invention. Parts in the figure equivalent to those in FIG. 2 are indicated by the same numbers as in FIG. 2. Description of the identical parts is omitted to avoid redundancy. A second front glass panel 6 in the second embodiment is made up to a two-layer structure of a Fresnel lens plate **6*a* processed to a Fresnel-lens shape and a lenticular lens sheet 6*b*. The Fresnel lens 6*a* is closely attached to the color filter 4**.

In the structure shown in FIG. 8, the lights fed out through the color filter 4 are not uniform as indicated in the figure.

But, the Fresnel lens 6*a* acts to bring the lights to become rather parallel. When the output lights are arranged in the direction in some degree before being fed to the lenticular lens sheet 6*b* as such, the directivity of the output lights can be controlled relatively freely irrespective of design of the lenticular lens. Such a technique can be applied to the PDP to provide great effect, while it is used for a projection TV set having a CRT used therein.

The second embodiment, as shown in FIG. 8, has the optical device on both sides of the second front glass panel 6 each. It need hardly be said that the optical device may be provided only on a single side. While the figure has intervals of the lenticular lens indicated rather wide, they should be desirously fine in view of resolution. Also, it need hardly be said that the intervals should be made optimum in view of the optical design and workability.

Figure 9:
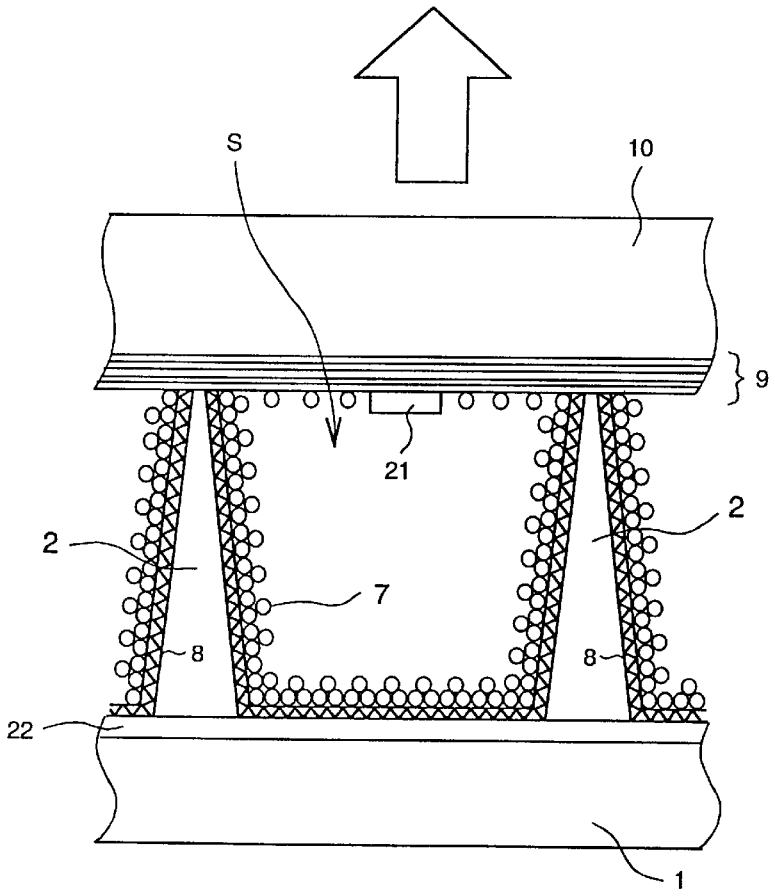
FIG. 9 is a cross-sectional view illustrating major portions of a third embodiment of the plasma display system according to the present invention.
Figure 10:
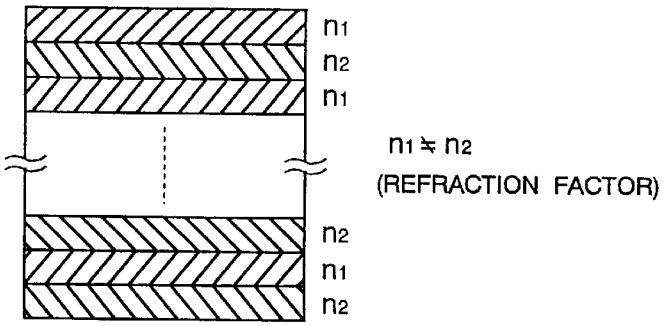
FIG. 10 is an enlarged cross-sectional view illustrating a plasma interference film filter of the embodiments of the present invention.

FIG. 9 depicts a cross-sectional view illustrating major portions of a third embodiment of the plasma display system according to the present invention. Parts in the figure equivalent to those in FIG. 2 are indicated by the same numbers as in FIG. 2. Description of the identical parts is omitted to avoid redundancy. The third embodiment has the above-described interference film (multi-layer interference film) 9 indicated in FIG. 10 and a face panel 10. The third embodiment is an example of application of the interference film, having the thin-film interference filter 9 provided on an inside (cell S side) of the face panel 10.

It is preferable that the ultraviolet ray generated in the cell S is all absorbed by the phosphor 7 to excite the phosphor 7 to emit the visible light. Considering the current panel on the basis of such a principle, we can find that the area for feeding out the light occupies a large part of the area of the wall surfaces of the whole cell. There is no problem if the light output face (face panel) can be coated fully with the phosphor. However, the current face panel cannot be coated enough to use the ultraviolet ray effectively in connection with the light output needed to display. To solve such a problem, as shown in FIG. 9, the third embodiment is made to have the thin-film interference filter 9 provided on the opening for feeding out the display light, or rather on the whole inside of the face panel 10, so that it can reflect only the ultraviolet ray to excite the phosphor while transmitting the visible light. Such a structure does not make the opening of the face panel 10 serve as loss for the exciting ultraviolet ray. When the face panel 10 has the thin-film interference filter 9 for reflecting only the ultraviolet ray, the thin-film interference filter 9 reflects the exciting ultraviolet, which excites the phosphors 7 on the barrier ribs 2 and the bottom of the cell S. Therefore, it need hardly be said that the phosphor 7 coated on the face panel 10 has no sense as with the case that the face panel 10 has no thin-film interference filter 9.

The structure of the thin-film interference filter 9, like the thin-film interference filter shown in FIG. 9 for use in the first embodiment of the present invention, has thin films of refraction factors n1 an n2 overlapped alternately to obtain a desired characteristic. The thin-film interference filter 9 in the third embodiment should be designed as transparent filter to make necessary spectrum components pass through.

What is claimed is:

1. A plasma display system comprising a plurality of cells having respective light emitting areas separated spatially for respective primary color lights wherein respective phosphors on an inner surface of the cells are excited by energy of an ultraviolet ray to obtain visible lights, said cells comprising:

a face panel for feeding out lights, the face panel including a first front panel positioned at an upper portion of the cell, the first front panel being formed of a thin transparent plate, and a second front panel positioned outside of the first front panel, the second front panel being formed of a transparent plate having an optical characteristic for controlling directivity of the light, and wavelength-selective filters being provided between said first and second front panels formed over the respective cells, said filters transmitting respective primary color lights.

2. A plasma display system according to claim 1, wherein the cells further comprise wavelength-selective filters or reflectors on the inner surface of the respective cells.

3. A plasma display system comprising a plurality of cells having light emitting areas separated spatially for color lights wherein phosphors on an inner surface of the cells are excited by energy of an ultraviolet ray to obtain visible lights, each cell comprising:

a face panel for feeding out lights, the face panel including a first front panel positioned at an upper portion of the cell, the first front panel being formed of a thin transparent plate, and a second front panel positioned outside of the first front panel, the second front panel being formed of a transparent plate having an optical characteristic for controlling directivity of the light, and an optical filter layer interleaved between the first front panel and the second front panel, the optical filter layer allowing virtually only light components for a respective color light to pass through.

4. A plasma display system according to claim 3, wherein each cell further comprises a wavelength-selective filter or reflector on the inner surface of the cell.

5. A plasma display system according to claim 3, wherein an area of the optical filter of each cell corresponding to each emitted light color is made wider than an opening area of the cell.

6. A plasma display system according to claim 3 or 5, each cell further comprising a black opaque member for absorbing light, the black opaque member being positioned between the optical filters of different colors corresponding to the cells.

7. A plasma display system comprising a plurality of cells having respective light emitting areas separated spatially for respective primary color lights wherein respective phosphors on an inner surface of the cells are excited by energy of an ultraviolet ray to obtain visible lights, said cells comprising:

wavelength-selective filters for selectively reflecting respective primary color lights emitted by the respective phosphors, the respective filters being formed under the respective phosphors and on the inner surface of the respective cells; and a face panel for feeding out lights, the face panel including a first front panel positioned at an upper portion of the cell, the first front panel being formed of a thin transparent plate, and a second front panel positioned outside of the first front panel, the second front panel being formed of a transparent plate having an optical characteristic for controlling directivity of the light.

8. A plasma display system comprising a plurality of cells having light emitting areas separated spatially for color lights wherein phosphors on an inner surface of the cells are excited by energy of an ultraviolet ray to obtain visible lights, each cell comprising:

a wavelength-selective filter for selectively reflecting color lights emitted by the phosphors, the filter being formed under the phosphors and on the inner surface of the cell, a face panel for feeding out lights, the face panel including a first front panel positioned at an upper portion of the cell, the first front panel being formed of a thin transparent plate, and a second front panel positioned outside of the first front panel, the second front panel being formed of a transparent plate having an optical characteristic for controlling directivity of the light, and an optical filter layer interleaved between the first front panel and the second front panel, the optical filter layer allowing virtually only light components for a respective color light to pass through.

9. A plasma display system according to claim 8, each cell further comprising a black opaque member for absorbing light, the black opaque member being positioned between the optical filters of different colors corresponding to the cells.

10. A plasma display system comprising a plurality of cells having light emitting areas separated spatially for color lights wherein phosphors on an inner surface of the cells are excited by energy of an ultraviolet ray to obtain visible lights, each cell comprising:

a face panel delimiting an exit surface for the cell, a filter layer disposed on an upper surface of the face panel for substantially enabling light components of a single color to pass therethrough, and a lamination of a Fresnel lens and a lenticular lens disposed on the filter layer.

11. A plasma display system comprising a plurality of cells having light emitting areas separated spatially for color lights wherein phosphors on an inner surface of the cells are excited by energy of an ultraviolet ray to obtain visible lights, each cell comprising:

a face panel delimiting an exit surface for the cell, and a filter layer disposed on an upper surface of the face panel for substantially enabling light components of a single color to pass therethrough;

wherein the face panel is formed of a thin transparent plate and the filter layer is disposed on an upper surface of the thin transparent plate, another transparent plate being disposed over the filter layer and having an optical characteristic for controlling directivity of light.

12. A plasma display system according to claim 11, wherein at least an upper surface of the another transparent plate has a lens characteristic.

13. A plasma display system according to claim 11, wherein each cell further comprises a wavelength-selective filter or reflector on the inner surface of the cell.

14. A plasma display system comprising a plurality of cells having respective light emitting areas separated spatially for respective primary color lights wherein respective phosphors on an inner surface of the cells are excited by energy of an ultraviolet ray to obtain visible lights, said cells comprising:

wavelength-selective filters for selectively reflecting respective primary color lights emitted by the respective phosphors, the filters being formed under the respective phosphors and on the inner surface of the respective cells;

a face panel for feeding out lights, the face panel including a first front panel positioned at an upper portion of the cell, the first front panel being formed of a thin transparent plate, and a second front panel positioned outside of the first front panel, the second front panel being formed of a transparent plate having an optical characteristic for controlling directivity of the light; and an optical filter layer interleaved between the first front panel and the second front panel, the optical filter layer allowing virtually a light component for a respective primary color light to pass through.

15. A plasma display system according to claim 14, each cell further comprising a black opaque member for absorbing light, the black opaque member being positioned between the optical filters of different colors corresponding to the cells.

* * * * *